US005651872A

United States Patent [19]

Takeuchi et al.

[11] Patent Number: 5,651,872

[45] Date of Patent: Jul. 29, 1997

[54] COMPOSITE PLATING METHOD

[75] Inventors: Hiromitsu Takeuchi, Aichi-ken; Yoshiki Tsunekawa, Okazaki; Masahiro Okumiya, Nagoya, all of Japan

[73] Assignee: Toyoda Gosei Co., Ltd., Aichi-ken, Japan

[21] Appl. No.: 539,904

[22] Filed: Oct. 6, 1995

[30] Foreign Application Priority Data

Oct. 7, 1994 [JP] Japan ..... 6-244393

[51] Int. Cl.[6] ..... C25D 15/00; C25D 5/00; B05D 1/36

[52] U.S. Cl. ..... 205/109; 205/112; 205/133; 427/454; 427/258; 427/470; 427/466

[58] Field of Search ..... 148/243; 205/84, 205/98, 109, 112, 133, 170, 172, 176, 181, 187, 261, 271, 273, 89; 427/454, 405, 436, 258, 470, 466

[56] References Cited

FOREIGN PATENT DOCUMENTS 5-148689 6/1993 Japan .

OTHER PUBLICATIONS

Chemical Abstracts—abstract of Kawasaki et al., Kinzoku Hyomen Gijutsu, 1973, 24(4), 196–202 1973 no month available.

Chemical Abstracts—abstract of Hayashi et al., Interfinish 76, Tagungsberichtsband–Weltongr. Oberflaechenbehandl. Met., 9th (1976), Paper No. 18, 14 pp. 1976 no month available.

Chemical Abstracts—abstract of Ishimori et al., Kinzoku Hyomen Gijutsu, 1977, 28(10), 508–512 1977 no month available.

Chemical Abstracts—abstract of Perene et al., Tagungsband–Kammer Tewch. Suhl (1984), 74, 55–62 1984 no month available.

Tomaszewski et al., Codeposition of Finely Dispersed Particles with Metals, Plating, 1969, 1234–1239 1969 no month available.

*Primary Examiner*—Kathryn L. Gorgos
*Assistant Examiner*—Alex Noguerda
*Attorney, Agent, or Firm*—Cushman Darby & Cushman IP Group of Pillsbury Madison & Sutro, LLP

[57] ABSTRACT

A composite plating film is prepared from a composite plating solution containing a metal matrix and insoluble particles 4 dispersed therein or deposited therewith. The composite plating film has a non-uniform concentration of insoluble particles along a direction of the thickness of the composite film. The non-uniform concentration is achieved by changing the discharge rate of composite plating solution during deposition of the film on the base material.

12 Claims, 2 Drawing Sheets

COMPOSITE PLATING METHOD

BACKGROUND OF THE INVENTION

This disclosure claims priority from Japanese Patent Application No. 6-244,393 and is related to Japanese Unexamined Patent Publication 5-148,689, both of which are incorporated herein by reference.

1. Field of the Invention

The present invention generally relates to a method for preparing a plating film exhibiting excellent abrasion resistance, heat resistance, shock resistance, and adhesion strength.

2. Description of the Related Art

Methods for preparing a composite plating film on a surface of a base material by utilizing a composite plating solution are known in the art. According to such conventional methods, the composite plating solution is formed by dispersing insoluble particles such as alumina ($Al_2O_3$) in a metal matrix of a metal plating solution. Composite plating films prepared from such composite plating solutions generally have improved plating properties (e.g., abrasion resistance, heat resistance, and shock resistance) compared to pure metal plating films. However, the composite plating films prepared in accordance with most conventional methods fail to exhibit sufficiently acceptable plating properties.

It has been discovered that the above-described problems relating to ineffective plating properties can effectively be overcome by preparing a composite film having a non-uniform concentration of insoluble particles across the thickness (i.e., between the surfaces) of the composite plating film. For example, abrasion resistance is improved by increasing the concentration of insoluble particles at the outer surface of the composite plating film. Further, the adhesive strength of the composite plating film to a base material (substrate) is substantially improved by decreasing the concentration of insoluble particles at the inner surface of the film. Therefore, it is desirable to have a composite plating film with a non-uniform concentration of insoluble particles across its thickness (i.e., a higher concentration near the outer surface). Such a result can be achieved by practicing a method for forming a composite plating film having a so-called "gradating function," in which the concentration of insoluble particles continuously and gradually changes across the thickness of the film (i.e., from the outer surface of the film to the inner surface).

One method for practicing the gradating function for preparing a composition plating film is disclosed in Japanese Unexamined Patent Publication No. Hei 5-148689. According to this conventional method, the concentration of insoluble particles as a variable of film thickness is controlled by adjusting the specific surface area of the insoluble particles in the metal plating solution. This method is premised on the principle that the quantity of insoluble particles to be deposited in a metal matrix can be increased by decreasing the specific surface areas of the particles.

However, this conventional method also possesses inherent disadvantages. For example, practice of this method requires that a large number of different plating solutions be prepared—i.e., for each of the different specific surface areas, a corresponding plating solution is required.

Accordingly, practice of this conventional method requires the acquisition of large-scale plating equipment. For example, for each solution, a separate and corresponding plating solution tank must be provided.

In addition, precise and constant supervision is necessary to properly select from and switch between the plating solutions to achieve a gradual and continuous gradating function. Notwithstanding such supervision, it is extremely difficult to gradually change the composition of insoluble particles in a gradual and continuous manner as a function of film thickness.

SUMMARY OF THE INVENTION

The present invention solves the aforementioned problems associated with the prior art as well as other problems by providing a method for preparing a composite plating film having a non-uniform concentration of insoluble particles along its thickness.

It is therefore an objective of the present invention to provide a composite plating method which allows for the easy and precise control of the concentration of insoluble particles as a function of film thickness so as to prepare a composite plating film having, for example, a gradual and continuous variation in concentration of insoluble particles from one surface of the film to the other.

It is another object of the present invention to provide a composite plating method which does not require complex and expensive equipment.

It is a further object of the present invention to provide a composite plating method which is easily supervised and controlled to achieve a desired gradating function across the thickness of the composite plating film.

In order to achieve the foregoing and other objectives, the present invention provides a composite plating method for forming a composite plating layer on a surface of a base material. The composite plating solution contains a metal plating solution and insoluble particles dispersed in the metal plating solution. The concentration of insoluble particles in the film is varied across the thickness of the film by altering the flow rate at which the composite plating solution is introduced to a surface of a base material.

BRIEF DESCRIPTION OF THE DRAWINGS

The present invention, together with the objects and advantages thereof, may best be understood by reference to the following description of the presently preferred embodiments taken in conjunction with the accompanying drawings in which.

DETAILED DESCRIPTION OF THE PREFERRED EMBODIMENTS

A preferred embodiment of the present invention will be described below referring to FIGS. 1 to 3.

Figure 2:
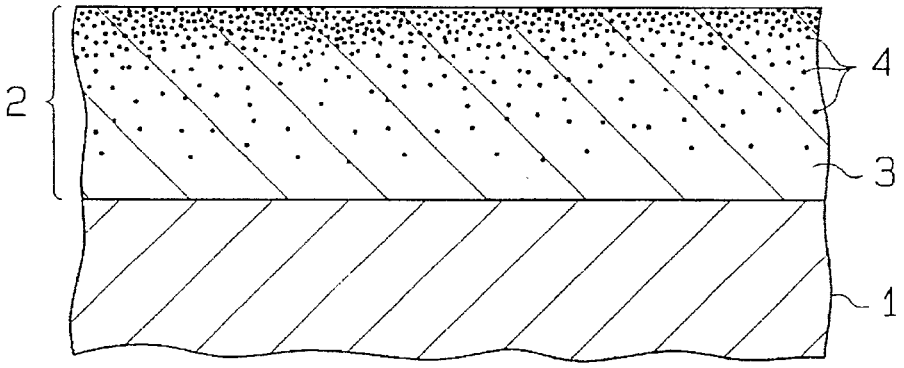
FIG. 2 is a cross-sectional view of a base material and a composite plating film.

FIG. 2 shows schematically a cross-sectional view of a composite plating film 2 formed on the surface of a base material 1 according to the preferred embodiment of the present invention. An exemplary base material 1 is aluminum. The film 2 preferably contains nickel as a metal matrix 3 and alumina as insoluble particles 4 deposited with or dispersed in the matrix 3. Preferably, the insoluble particles have an average particle size of about 1.7 μm.

In accordance with the preferred embodiment, the amount of insoluble particles 4 deposited on the base material is controlled so that the concentration of insoluble particles 4 in the film 2 continuously and gradually changes from a first surface (unnumbered) of the film 2 (which interfaces with a surface of the base material 1) to a second opposing surface of the film 2 (unnumbered), the thickness of the film 2 being defined therebetween. The thickness of the composite plating film 2 is preferably about 50 μm. According to this preferred embodiment, the concentration of insoluble particles 4 in the metal matrix increases in a direction from the first surface to the second surface of the film 2, such that the insoluble particles constitute about zero volume percent at the first surface, and at the second surface about 30 vol. % for abrasion resistant films or about 10 to about 15 vol. % for heat resistant films.

Next, a plating apparatus for forming the above-described composite plating film 2 having a non-uniform concentration of insoluble particles 4 as a variable of the plating film thickness will be described.

Figure 1:
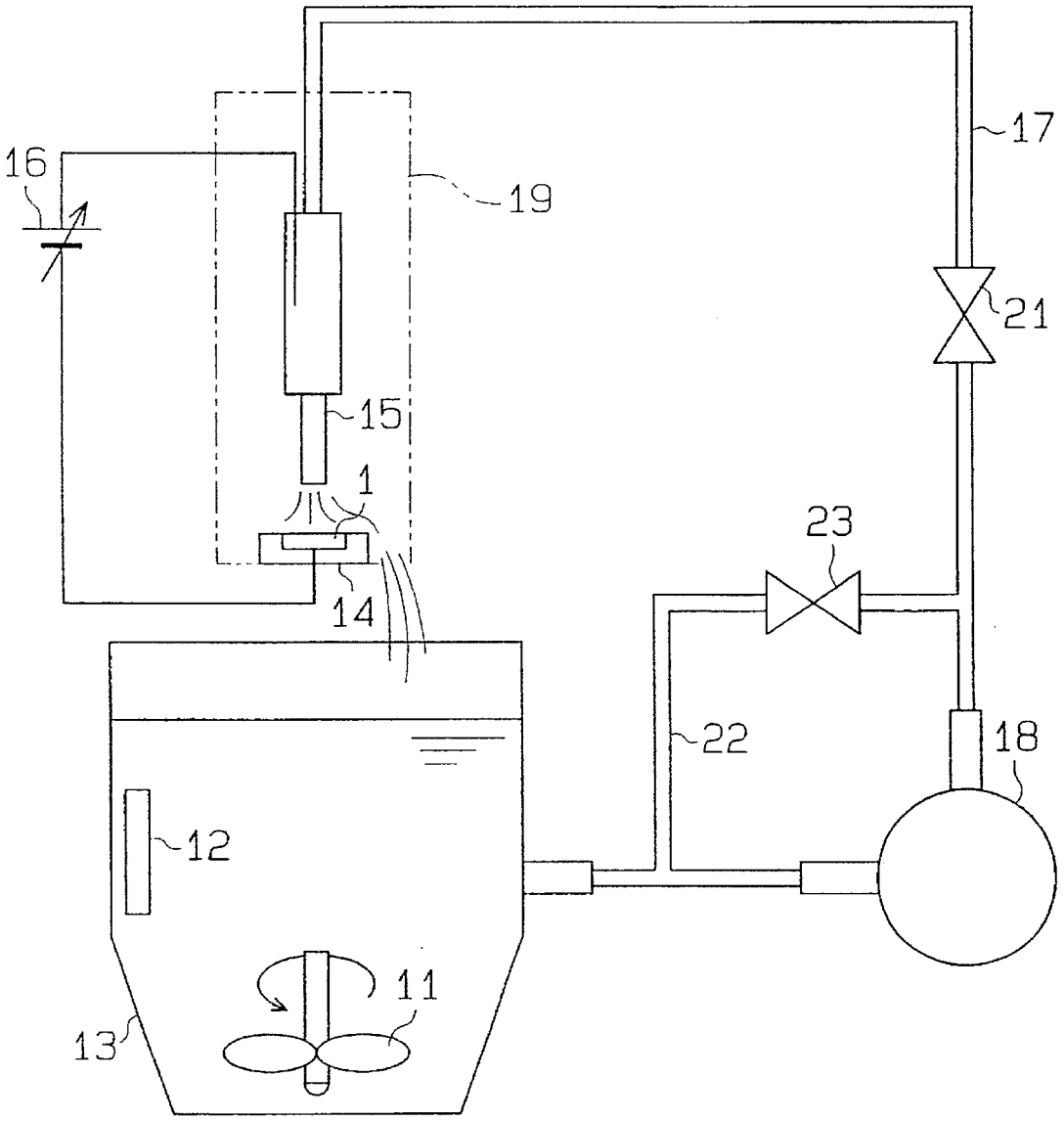
FIG. 1 is a systematic diagram showing a plating apparatus for practicing an embodiment of the present invention.

As shown in FIG. 1, the plating apparatus according to this embodiment includes a (or container) 13 having a stirrer 11 and a heater 12 disposed therein. The tank contains a composite plating solution (not shown) of a composition to be described below.

According to this embodiment, a table 14 is provided for receiving the base material 1. The table is disposed above the tank 13, and a nozzle 15 is disposed above the table 14. The nozzle 15 is connected to an anode of a power supply 16, while the table 14 is connected to the cathode of the power supply 16. A communication passage 17 connects the tank 13 with the nozzle 15.

The communication passage 17 contains a pump 18. In its operative state, the pump 18 drives the composite plating solution from the tank 13, in which the solution is heated and stirred homogeneously, through the communication passage 17 and to the nozzle 15. The nozzle 15 is constructed and arranged to discharge (e.g., spray) the composite plating solution therefrom so that the solution is introduced onto the interfacing surface of the base material 1, which is disposed on the table 14. Preferably, the table and the nozzle 15 are housed in a box-like jet cell 19 so that the discharged composite plating solution does not undesirably splatter into other components of the apparatus, such as the tank 13.

A main valve 21 is disposed along the communication passage 17 on the downstream side of the pump 18. The amount of the composite plating solution discharged from the nozzle 15 is controlled by partially or completely opening and closing the valve 21. A bypass passage 22, which bypasses the pump 18, provides an alternative flow path, with the entrance (unnumbered) of the bypass passage 22 being located upstream from the pump 18 along the communication passage 17 and the exit (unnumbered) of the bypass passage 22 being located downstream from the pump 18 along the communication passage 17. A sub-valve 23 is disposed in the bypass passage 22. The flow rate of the composite plating solution passing through the bypass passage 22 and discharged from the nozzle 15 is controlled by partially or completely opening and closing the valves 21 and 23.

Preferably, the composite plating solution in this embodiment includes a metal plating solution (unnumbered) and insoluble particles 4. A suitable composition for the composite plating solution is, for example, $NiSO_4$ (about 300 g/L), $NiCl_2$ (about 60 g/L), and $H_3BO_3$ (about 40 g/L), and insoluble particles 4 contained (dispersed) in the solution at a concentration of about 50 g/L. The plating conditions are preferably selected so that the temperature of the composite plating solution is maintained at 55° C. by the heater 12, the pH and current density are about 4.5 and about $40\times10^2$ $A/m^2$, respectively, and the plating solution contact time is about 480 seconds. The concentration of insoluble particles 4 can be greater, but is preferably less than 500 g/L.

Alternative plating solutions containing metals and/or alloys which are suitable for plating can also be practiced in accordance with the present invention. For example, other suitable compositions for a plating solution include: (1) a chromium plating solution of $Cr_2(SO_4)_3.18H_2O$ (about 138 g/L), CHOOK (about 80 g/L), $NH_3Br$ (about 10 g/L), $NH_4Cl$ (about 54 g/L), KCl (about 76 g/:), and $H_3BO_3$ (about 40 g/L); and (2) a copper plating solution of $CuSO_4.5H_2O$ (about 200 g/L) and $H_2SO_4$ (about 60 g/L).

Table 1 lists exemplary insoluble particles for several suitable compositions for the metal matrix of the present invention.

TABLE 1

| matrix | insoluble particles |
|---|---|
| Ni | $Al_2O_3$, $Cr_2O_3$, $Fe_2O_3$, $TiO_2$, $ZrO_2$, $ThO_2$, $SiO_3$, $CeO_2$, $BeO_2$, MgO, CdO, diamond, SiC, TiC, WC, VC, ZrC, TaC, $Cr_3C_2$, $B_4C$, BN (α,β), $ZrB_2$, TiN, $Si_3N_4$, $WSi_2$, PTFE, graphite fluoride, graphite, $MoS_2$, $WS_2$, $CaF_2$, $BaSO_4$, $SrSO_4$, ZnS, CdS, $TiH_2$, Cr, Mo, Ti, Ni, Fe, W, V, Ta, glass kaolin, micro capsule |
| Cu | $Al_2O_3$ (α,τ), $TiO_2$, $ZrO_2$, $SiO_2$, $CeO_2$, SiC, TiC, WC, ZrC, NbC, $B_4C$, BN, $Cr_3B_2$, PTFE, graphite fluoride, graphite, $MoS_2$, $WS_2$, $BaSO_4$, $SrSO_4$ |
| Co | $Al_2O_3$, $Cr_2O_3$, $Cr_3C_2$, WC, TaC, $ZrB_2$, BN, $Cr_3B_2$, diamond |
| Fe | $Al_2O_3$, $Fe_2O_3$, SiC, WC, B, PTFE, $MoS_2$ |
| Cr | $Al_2O_3$, $CeO_2$, $ZrO_2$, $TiO_2$, $SiO_2$, $UO_2$, SiC, WC, $ZaB_2$, $TiB_2$ |
| Au | $Al_2O_3$, $Y_2O_3$, $SiO_2$, $TiO_2$, $ThO_2$, $CeO_2$, TiC, WC, $Cr_3B_2$ |
| Ag | $Al_2O_3$, $TiO_2$, BeO, SiC, NB, $MoS_2$, corundom, graphite |
| Zn | $ZrO_2$, $SiO_2$, $TiO_2$, $Cr_2O_3$, SiC, TiC, $Cr_3C_2$, Al |
| Cd | $Al_2O_3$, $Fe_2O_3$, BC, corundom |
| Pb | $Al_2O_3$, $TiO_2$, TiC, BC, Si, Sb, corundom |
| Sn | corundom |
| Ni—Co | $Al_2O_3$, SiC, $Cr_3C_2$, BN |
| Ni—Fe | $Al_2O_3$, $Eu_2O_3$, SiC, $Cr_3C_2$, BN |
| Ni—Mn | $Al_2O_3$, SiC, $Cr_3C_2$, NB |
| Pb—Sn | $TiO_2$ |
| Ni—P | $Al_2O_3$, $Cr_2O_3$, $TiO_2$, $ZrO_2$, SiC, $Cr_3C_2$, $B_4C$, diamond PTFE, BN, $CaF_2$ |
| Ni—B | $Al_2O_3$, $Cr_2O_3$, SiC, $Cr_3C_2$, diamond |
| Co—B | $Al_2O_3$, $Cr_2O_3$, BN |

Next, a plating method for forming the composite plating film 2 using the above-described plating apparatus will be described.

In accordance with the preferred embodiment of the present invention, the composite plating method is conducted by placing the base material 1 on the table 14, and actuating the power supply 16 to operate the pump 18. It should be noted here that the sub-valve 23 is preferably totally closed and the main valve 21 is preferably substantially open at the initial stage of operation. The pump 18 drives the composite plating solution through the communication passage 17 until the solution is discharged from the nozzle 15 and in turn received by the interfacing surface of the base material 1. Here, the nozzle 15 serves as an anode, and the base material 1 serves as a cathode. Thus, electroplating is carried out to form a nickel-based metal matrix 3 on the surface of the base material 1. The metal matrix 3 preferably has a pure metal nickel chemical structure. The metal matrix 3 is formed by nickel ions in the electrolyte solution continuously contacting the cathode.

It has been discovered by the present inventors that if the solution is discharged at a high flow rate, the insoluble particles 4 are not adsorbed on the base material 1; rather, the insoluble particles are displaced from the surface of the base material so that substantially no insoluble particles 4 are retained in the metal matrix 3. Accordingly, the metal matrix 3 possesses a relatively high purity in a region adjacent to the base material 1.

The flow rate of the composite plating solution discharged from the nozzle 15 is thereafter gradually reduced by closing the main valve 21 or opening the sub-valve 23. As a result, the exit flow rate of the discharged plating solution is decreased; consequently, the quantity of the insoluble particles 4 in the metal matrix 3 increases. That is, by continuously decreasing the flow rate of the discharged plating solution, the concentration of insoluble particles in the resulting film is increased from one surface of the composite plating film 2 to the other (i.e., across the thickness of the film 2) during formation of the film.

As explained above, when the composite plating solution is introduced to the base material 1 at a high flow rate, the metal matrix 3 (i.e., Ni-ions in the electrolytic solution) are retained on the base material 1, while the insoluble particles are displace therefrom. It is believed that this result is due to the weak static electricity attractive forces between the insoluble particles and the base material 1. The shearing force of a high flow rate plating solution is sufficient to overcome these weak forces and thereby displace the insoluble particles from the base material. On the other hand, the Ni-ions of the solution form metallic bonds with the surface of the base material 1. The metallic bonds are stronger than the static electricity forces; consequently, the metal matrix is more likely to be retained by the base material 1.

The resulting composite plate film 2 has an improved adhesive property at the inner surface thereof (with respect to the interfacing base material 1), as well as excellent abrasion resistance at the outer surface thereof.

Unlike the prior art technique where the concentration of insoluble particles deposited on the base material 1 is controlled by selecting one of a plurality of tanks, each having a solution with particles of a different specific surface area, only one composite plating solution is needed according to the embodiment of the present invention. In other words, only one plating tank (tank 13) is necessary, resulting in simplification of equipment, improvement of workability, and a shorter production time.

Described below are the procedures and results of experiments that were carried out in order to confirm the improved adhesive and abrasive properties of films made in accordance with the present invention. Composite plating films 2 were formed by changing the flow rate of the composite plating solution. Experiments were performed on solutions having different average sizes of insoluble particles 4. Other plating conditions were substantially the same as described above. For example, a metal plating solution containing $NiSO_4$ (300 g/L), $NiCl_2$ (60 g/L), and $H_3BO_3$ (40 g/L) was used, in which the concentration of the insoluble particles 4 (dispersed) was of 50 g/L. The plating conditions were preset such that the temperature of the composite plating solution was maintained at 55° C. by the heater 12, the pH and current density were 4.5 and $40\times10^2$ A/m$^2$, respectively, and the plating solution contact time was 480 seconds. The test results are shown in FIG. 3.

Figure 3:
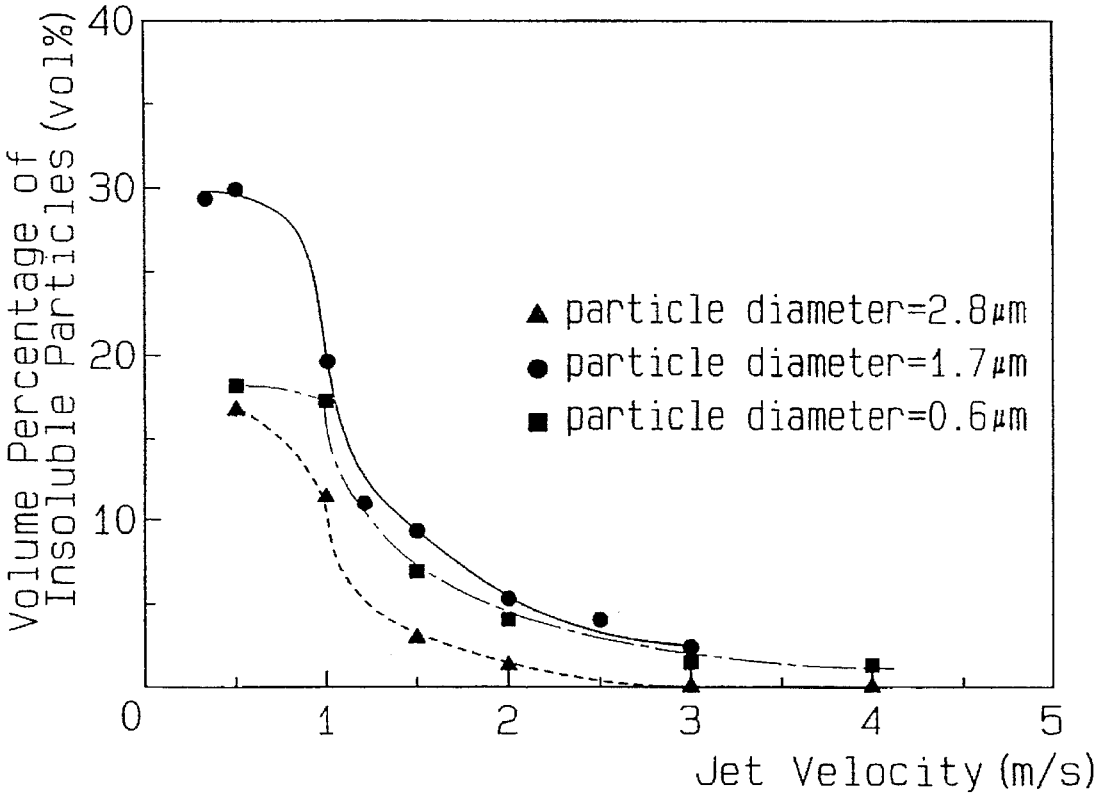
FIG. 3 is a graph showing the amount of insoluble particles deposited on a base material as a function of flow rate.

As shown in FIG. 3, the amount of insoluble particles 4 deposited on the base material varies as a function of flow rate, irrespective of the particle size of the particles 4 dispersed in the composite plating solution. For example, 20 to 30 vol % of the insoluble particles are deposited at a flow rate of about 0.5 m/s, and the amount decreases with the increase in the flow rate. At the flow rate of about 3 m/s to about 4 m/s, the codeposited insoluble particles 4 amounts to about less than 1 vol. % for each solution. These test results show that the rate of deposition of the insoluble particles can be easily and effectively controlled by suitably adjusting the flow rate.

Although the present invention has been described in detail with reference to its presently preferred embodiments, it should be understood by those skilled in the art that various modification and variations can be made without departing from the spirit or scope of the present invention. For example, the present invention can be embodied in the following manners.

(1) The flow rate of the metal plating solution can be increased during practice of the method. In such cases, the concentration of insoluble particles 4 in the resulting composite plating film is lower at the outer (second) surface than at the inner (first) surface;

(2) The plating need not be carried out by means of electrolysis plating. In addition, the composition of the metal plating solution and insoluble particles, as well as other plating conditions, can be changed suitably depending on the desired application of the resulting composite plating film; and (3) While the composite plating solution is sprayed out of the nozzle 15 according to one embodiment of the invention, any other method for discharging the solution can be employed so long as the composite plating solution received by the base material 1 has a sufficient flow rate to allow the concentration of insoluble particles to be thereby controlled.

Therefore, the present embodiment is to considered as illustrative and not restrictive, and the invention is not to be limited to the details given herein, but may be modified within the scope of the appended claims.

What is claimed is:

1. A method for preparing a composite plating film on a surface of a base material comprising:

providing a container containing a composite plating solution, the composite plating solution containing a metal plating solution and insoluble particles dispersed therein, disposing a base material free of contact from the plating solution contained in the container, spraying the composite plating solution at a surface of the base material at a flow rate so as to form a composite plating film having a first surface adjacent to the base material, a second surface opposing said first surface, and a thickness defined between the surfaces; and varying the flow rate of the composite plating solution sprayed to the base material so as to control the concentration of insoluble particles codeposited on the base material.

2. A method according to claim 1, wherein said step of varying is conducted by gradually and continuously increasing the flow rate of the composite plating solution so that the concentration of insoluble particles increases from the first surface to the second surface of the film.

3. A method according to claim 1, wherein said step of varying is conducted by gradually and continuously decreasing the flow rate of the composite plating solution so that the concentration of insoluble particles decreases from the first surface to the second surface of the film.

4. A method according to claim 1, further comprising the step of preparing the composite plating film from about 300 g/L of $NiSO_4$, about 60 g/L of $NiCl_2$, and about 40 g/L of $H_3BO_3$.

5. A method according to claim 1, wherein the insoluble particles have an average particle size of about 1.7 μm.

6. A method according to claim 1, wherein the composite plating film has a concentration of insoluble particles at the first surface of about 0 vol % and a concentration of insoluble particles at the second surface of about 30 vol %.

7. A method according to claim 1, wherein the composition plating film has a concentration of insoluble particles at the first surface of about 0 vol %, and a concentration of insoluble particles at the second surface of about 10 vol % to about 15 vol %.

8. A method for preparing a composite plating film on a surface of a base material comprising:

providing a container containing a composite plating solution, the composite plating solution containing a metal plating solution and insoluble particles dispersed therein, disposing a base material free of contact from the plating solution contained in the container, spraying the composite plating solution at a surface of the base material at a flow rate so as to form a composite plating film having a first surface adjacent to the base material, a second surface opposing said first surface, and a thickness defined between the surfaces; and gradually and continuously varying the flow rate of the composite plating solution sprayed to the base material so as to control the concentration of insoluble particles codeposited on the base material.

9. A method for preparing a composite plating film on a surface of a base material by electroplating, said method comprising:

providing a container containing a composite plating solution, the composite plating solution containing a metal plating solution and insoluble particles dispersed therein;

disposing a base material free of contact from the plating solution contained in the container, the base material serving as or being connected to a cathode;

spraying the composite plating solution from a spraying device at a portion of a surface of the base material at a flow rate so as to form a composite plating film on the portion, the composite plating film having a first surface adjacent to the base material, a second surface opposing said first surface, and a thickness defined between the surfaces, the spraying device serving as or being connected to an anode; and varying the flow rate of the composite plating solution sprayed to the base material so as to control the concentration of insoluble particles codeposited on the base material.

10. A method according to claim 9, wherein said step of varying is conducted by gradually and continuously increasing the flow rate of the composite plating solution so that the concentration of insoluble particles increases from the first surface to the second surface of the film.

11. A method according to claim 9, wherein said step of varying is conducted by gradually and continuously decreasing the flow rate of the composite plating solution so that the concentration of insoluble particles decreases from the first surface to the second surface of the film.

12. A method for preparing a composite plating film on a surface of a metallic base material by electroplating, said method comprising:

providing a container containing a composite plating solution, the composite plating solution containing a metal plating solution and insoluble particles dispersed therein;

disposing a base material free of contact from the plating solution contained in the container, the base material serving as or being connected to a cathode;

spraying the composite plating solution from a spraying at a portion of a surface of the metallic base material at a flow rate so as to form a composite plating film on the portion, the composite plating film having a first surface adjacent to the metallic base material, a second surface opposing said first surface, and a thickness defined between the surfaces, the spraying device serving as or being connected to an anode; and varying the flow rate of the composite plating solution sprayed to the metallic base material so as to control the concentration of insoluble particles codeposited on the metallic base material.

* * * * *